United States Patent [19]

Livingstone

[11] Patent Number: 4,464,798

[45] Date of Patent: Aug. 14, 1984

[54] GARMENT HAVING CONCEALED POUCH

[76] Inventor: Jeanne Livingstone, 1025 Stuart St., Helena, Mont. 59601

[21] Appl. No.: 498,321

[22] Filed: May 26, 1983

[51] Int. Cl.[3] ..... A41D 27/20

[52] U.S. Cl. ..... 2/247

[58] Field of Search ..... 2/247, 248, 249, 250, 2/251, 252, 253, 211

[56] References Cited

U.S. PATENT DOCUMENTS 1,013,764 1/1912 Goldberg ..... 2/247

2,428,477 10/1947 Thompson ..... 2/247

*Primary Examiner*—Doris L. Troutman

*Attorney, Agent, or Firm*—John Gibson Semmes

[57] ABSTRACT

A garment pouch for retaining and concealing small personal valuables. One or more concealed hemline pockets are provided in a pouch formed upon an undergarment skirt, blouse or slip. The pockets are in-line with each other and are disposed above the hem of the garment, the pockets being formed of one or more laminates which are sealed at the top and bottom and secured to the exterior or interior of the skirt, blouse or slip, the laminates forming anchors for elements of an elongate pouch closure such as a zipper or other closure elements. Pockets are divisible from each other by vertical stitching from hemline to selvage. Each of the pockets may be easily accessible from the exterior or interior of the garment and may also be adapted to sportswear having the undergarment as an integral part of the whole, for example, as in golf skirts, tennis shorts and skirts and swimwear, having outer and inner pants. The wearer of the garment pouch need not undress to retrieve the valuables quickly and easily from any one or more of the garment pockets therein.

10 Claims, 3 Drawing Figures

GARMENT HAVING CONCEALED POUCH

CROSS REFERENCE TO RELATED APPLICATION

The invention is related to my corresponding patent application of the same title, Ser. No. 403,541, filed July 30, 1982 of the same title. The present invention is distinguishable, primarily on the basis that the closure construction is not dependent upon its relation to the hemline of the garment, per se.

BACKGROUND OF INVENTION

1. Field of the Invention

Whereas the invention is defined in terms of female undergarments, it is equally useful when applied to the hem or area adjacent the selvage of most any vestment wherein it may be desirable to seclude and temporarily retain relatively lightweight valuables and personal articles such as: keys, change and/or bills, credit cards, mediation, passports, small items of jewelry, etc.

2. The Prior Art

The known prior art is best represented by the patents to M. Sophier, U.S. Pat. No. 2,359,012; A. E. Weatherly, U.S. Pat. No. 2,593,711; A. E. Harvey, U.S. Pat. No. 2,492,862 and finally M. Wallach, U.S. Pat. No. 4,145,762. Whereas the aforesaid art is directed to the formation of various pocket-equipped garments and in some instances concealed pockets therefor, no effort has been made heretofore to form the pouch of integral garment elements, notably such as may be disposed in or around the locus of the flexible hemline upon which it may depend for support. This invention, as will be noted, is directed to the latter, in distinction to the former.

SUMMARY OF THE INVENTION

The invention, as will be more fully described hereinafter, is directed primarily to the formation of a concealed pocket or pouch, some of the principal elements of which comprise normal components of the garment itself, most notably, as in female clothing the skirt, its hem and/or selvage of the skirt. For example, the invention would be particularly adapted to the formation of a concealed pocket in a half slip or full slip, wherein the closure of the invention depends in part upon the skirt as its backing and wherein the bottom portion of the closure comprises the selvage of the hem of such a garment. Since the pockets are located at the hemline, the valuables do not add undesirable girth to the hips or waist and are easily retrieved without undressing. These and other objectives of invention will become more apparent from reference to the following drawings in which:

DESCRIPTION OF THE PREFERRED EMBODIMENT

Figure 1:
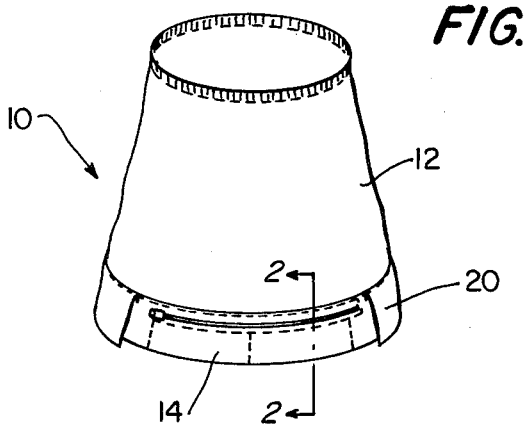
FIG. 1 is a vertical front elevational view of a skirt or slip, a portion thereof being broken away to reveal the details of the invention from the front.
Figure 2:
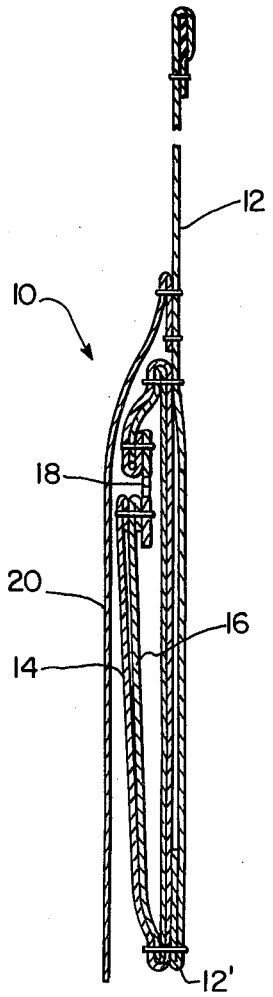
FIG. 2 is a vertical sectional view of the invention of FIG. 1 taken along the lines 2—2 thereof.

With reference to the drawings, FIG. 1 illustrates a preferred embodiment of the invention 10 as applied to either a half slip or full slip 12, wherein concealed pockets may be accessed from the exterior. The slip 12 includes a bottom hem which is of conventional design.

In this preferred form of invention 10, the slip itself forms the backing for the closeable pocket and for an overlying concealed flap 20. The slip 12 is folded upon itself at the hem, i.e., at the bottom 12', wherein appropriate stitching at the selvage secures the skirt to the other elements forming the pocket. These elements include a pocket exterior laminate 14 which is preferably formed of the same lightweight material as the skirt, per se. This pocket exterior 14 overlies the reinforcing pocket interior laminate 16, each of the same being folded at the lowermost closure ends for re-enforcement to secure the fastener 18 at its bottom. Intermediate ends of these laminates, they are folded upon themselves at the bottom of the skirt 12, where stitching of the selvage compresses them together, forming therewith a pocket or pouch bottom which consists of six layers in all. The laminates 14 and 16 are folded a third time at the top to create the pocket top, which is stitched to the skirt; a total of five laminates being thus compressed. Laminates 14 & 16 are folded and stitched a fourth time to provide a reinforced anchor for the top of the fastener 18. In this showing, the fastener comprises a zipper.

Clearly the laminates 14 and 16 may be increased or decreased in number, depending upon the durability and/or related quality of the pouch which may be desired. In the preferred structure shown, the pouch laminates are two in number, each being composed of the same material as the shirt. As indicated, adjacent and below the uppermost portion of the pocket, the exterior laminate 14 overlies and folds back upon itself over the end of inside pocket laminate 16. The laminate 14, having been secured by stitching to form with backing 12, the top of the pocket. The closure may contain any conventional fastener device such as a zipper or the product Velcro-buttons, snaps, hooks and eyes, etc.

Immediately above the aforesaid stitching, the concealing flap 20 is secured by transverse stitching to the skirt 12 to overlie the pocket, end to end, the concealing flap being reinforced at its end by folding at the top and by selvage stitching, as shown.

Figure 3:
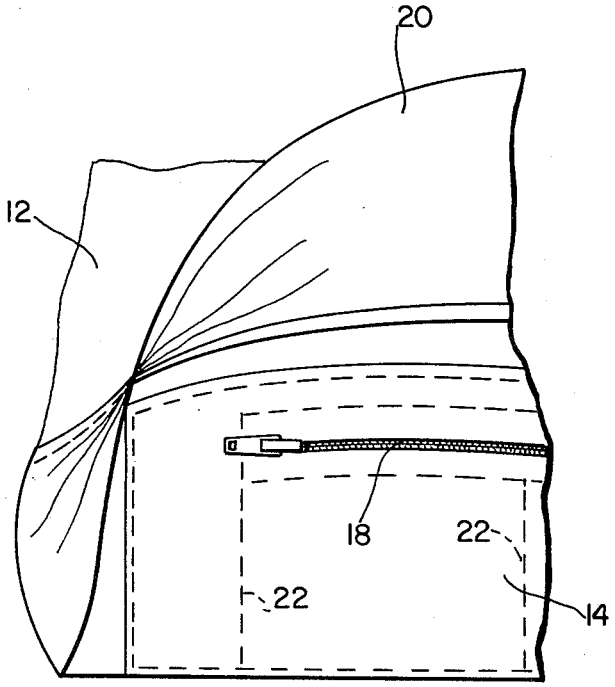
FIG. 3 is an enlarged front view of the invention, a portion thereof being broken away to show the relationship of the concealed and concealing elements to each other.

Plural in-line pockets are formed by vertical stitching of the closure to the skirt, reference FIG. 3. This stitching 22 preferably extends vertically from the selvage of the skirt to the bottom of the fastener 18.

From reference to the drawings and description, it will be apparent that the garment pouch may be secured to the interior of the skirt as well as to its exterior. To create such a concealed closure, the interior of the skirt will comprise the backing for securing the elements thereto. In this instance, no exterior concealing flap is necessary. Moreover, where the skirt comprises an undergarment such as a slip, the exterior concealing flap may be dispersed with.

The scope of the invention is defined by the appended claims wherein I claim:

1. In combination with a flexible garment having a skirt with a hem at an open end thereof;

(A) at least one elongate pocket adjacent the open end of the skirt, said pocket being defined at its bottom by a selvage portion of the garment, the pocket comprising:

($A_1$) at least one laminate which is twice folded upon itself whereby a top and a bottom of the pocket is defined, the laminate terminating in opposed free ends and ($A_2$) an elongate fastener closure for the pocket adjacent the top thereof, the free ends of the laminate securing the closure against displacement; said at least one laminate being secured to the skirt adjacent the top of the laminate and the bottom thereof.

2. The garment of claim 1 wherein the product is concealed by a flap which is of increased overall dimension relative to the pocket, said flap being secured to the skirt above the topmost position of the pocket.

3. The garment of claim 1 wherein plural in-line pockets are formed by permanent binding of selected portions of the laminate to the skirt.

4. The garment of claim 2 wherein plural pockets are formed by permanent vertical binding of selected portions of laminates to the skirt.

5. The garment of claim 1 wherein the seam forming the pocket comprises the bottom end of the garment turned inwardly and wherein the pocket closure is secured to the external surface of the garment.

6. The garment of claim 2 wherein the seam forming the pocket comprises the bottom end of the garment turned inwardly and wherein the pocked is secured to the external surface of the garment.

7. The garment of claim 3 wherein the seam forming the pocket comprises the bottom end of the garment turned inwardly and wherein the pocket is secured to the external surface of the garment.

8. The garment of claim 4 wherein the seam forming the pocket comprises the bottom end of the garment turned inwardly and wherein the pocket is secured to the external surface of the garment.

9. The garment of claim 1 wherein the pocket is secured to the internal surface of the garment.

10. The garment of claim 3 wherein the pocket is secured to the internal surface of the garment.

* * * * *